US006773494B1

(12) United States Patent
Ganz

(10) Patent No.: US 6,773,494 B1
(45) Date of Patent: Aug. 10, 2004

(54) FLUID SEPARATOR UNIT FOR USE WITH DIESEL ENGINES

(76) Inventor: David J. Ganz, 7120 Maryland Ave., Hessville, IN (US) 46323-2772

( * ) Notice: Subject to any disclaimer, the term of this patent is extended or adjusted under 35 U.S.C. 154(b) by 0 days.

(21) Appl. No.: 10/141,731

(22) Filed: May 10, 2002

(51) Int. Cl.[7] ..... B01D 47/00; B01D 46/00

(52) U.S. Cl. ..... 96/414; 55/310; 55/319; 55/385.3; 55/423; 55/424

(58) Field of Search ..... 55/310, 319, 423, 55/424, 426, 392, 394, 385.3, DIG. 14; 96/414; 123/198 E

(56) References Cited

U.S. PATENT DOCUMENTS 552,572 A * 1/1896 Austin
1,981,089 A 11/1934 Carpenter
3,509,967 A * 5/1970 Ballard
3,903,858 A * 9/1975 Hecht
3,955,945 A * 5/1976 Bauer
3,978,671 A * 9/1976 Gonzalez
4,234,328 A * 11/1980 Hudson, Jr.
4,269,607 A * 5/1981 Walker
4,286,976 A * 9/1981 Eriksson
4,345,429 A 8/1982 Yasuhara
4,380,149 A 4/1983 Ludecke
4,396,504 A 8/1983 Tannehill
4,585,924 A 4/1986 Pakula
4,732,671 A 3/1988 Thornton et al.
5,034,036 A * 7/1991 Creek et al.
5,454,937 A 10/1995 Lewandowski
6,290,738 B1 * 9/2001 Holm

* cited by examiner

*Primary Examiner*—Duane S. Smith
(74) *Attorney, Agent, or Firm*—Donald R. Schoonover

(57) ABSTRACT

A fluid separator is connected to a vent of a diesel engine to trap particles, such as oil particles, that may be entrained in fluid that is being vented from the internal engine block to control pressure in that engine block. The fluid separator includes a housing that has an inlet port, an outlet port and a drain port. The drain port is located in a trap area of the housing and is opened to remove trapped particles and trapped oil to a suitable location.

4 Claims, 1 Drawing Sheet

FLUID SEPARATOR UNIT FOR USE WITH DIESEL ENGINES

BACKGROUND OF THE INVENTION

1. Field of the Invention

The present invention relates to the general art of diesel engines, and to the particular field of accessories for diesel engines.

2. Discussion of the Related Art

Many types of vehicles are present on modern highways. These vehicles include both passenger vehicles and vehicles used to transport commercial items. These vehicles also are powered by various forms of power plants, including internal combustion engines and diesel engines. The diesel engine has become very popular with all forms of vehicles.

The diesel engine has many advantages over the internal combustion engine and such advantages are well known. However, the diesel also has certain disadvantages as well.

One disadvantage, which is the focus of the present invention, is the tendency of such engines to deposit oil either on the engine itself or into the environment surrounding the vehicle. This oil can be deposited on a road surface or on the surface of a parking lot. Such oil is considered to be a contaminant and, therefore, is not desirable.

Therefore, there is a need for a system for inhibiting, and possibly preventing, the deposit of oil into the environment by diesel engines.

A vent system that is used to reduce pressure in the engine block is one source of this oil. The vent system routes fluid from the diesel engine block, but such fluid may have particles of oil entrained therein. The vent system is generally fluidically connected to the atmosphere adjacent to the engine. When this fluid is vented into the atmosphere, the entrained particles are also vented to the atmosphere. Oil or other liquid particles condense on the nearest surface, which can be the engine itself or a roadway or the like. This fluid can build up over time and become harmful to the surface or to the environment.

Therefore, there is a need for a system for inhibiting, and possibly preventing, the deposit of oil into the environment by a vent system associated with diesel engines.

PRINCIPAL OBJECTS OF THE INVENTION

It is an object of the present invention to provide a fluid separator unit for a diesel engine that removes oil from gases located in the internal engine block of the engine before that oil is exhausted to the atmosphere.

It is another object of the present invention to provide a fluid separator unit for a diesel engine that removes oil from gases located in the internal engine block of the engine before that oil is exhausted to the atmosphere, and can be monitored.

It is another object of the present invention to provide a fluid separator unit for a diesel engine that removes oil from gases located in the internal engine block of the engine before that oil is exhausted to the atmosphere, and that can be cleaned.

It is another object of the present invention to provide a fluid separator unit for a diesel engine that removes oil from gases located in the internal engine block of the engine before that oil is exhausted to the atmosphere, and that can be easily mounted on the engine.

SUMMARY OF THE INVENTION

These, and other, objects are achieved by a fluid separator unit that is mounted on the vent of a diesel engine and is fluidically connected to that vent. The vent is used to relieve pressure in the internal engine block and often contains oil entrained in the fluid being vented from the engine block. The fluid separator unit of the present invention is fluidically connected to the vent in a manner that traps this entrained oil prior to that oil being vented from the engine into the atmosphere or the like.

The fluid separator unit of the present invention includes a housing that is fluidically connected to the vent and which has a filter element therein as well as an oil trap. Fluid flowing through the housing of the fluid separator unit deposits oil that may be entrained therein on the filter element. This oil then drains to the oil trap before the fluid is vented to atmosphere. The oil trap can be drained periodically and can be monitored to determine if and when draining is required.

Using the fluid separator unit of the present invention, oil that may otherwise be vented to atmosphere and may collect on the engine or on the ground near the engine will be trapped and collected for disposal in a proper manner.

The fluid separator unit of the present invention can also be easily retrofit onto an existing engine so existing engines can be easily modified to take advantage of the fluid separator unit. Furthermore, the efficient mounting of the fluid separator unit of the present invention makes cleaning of the unit easy and expeditious.

DETAILED DESCRIPTION OF THE INVENTION

Figures 1, 2, 3, 4:
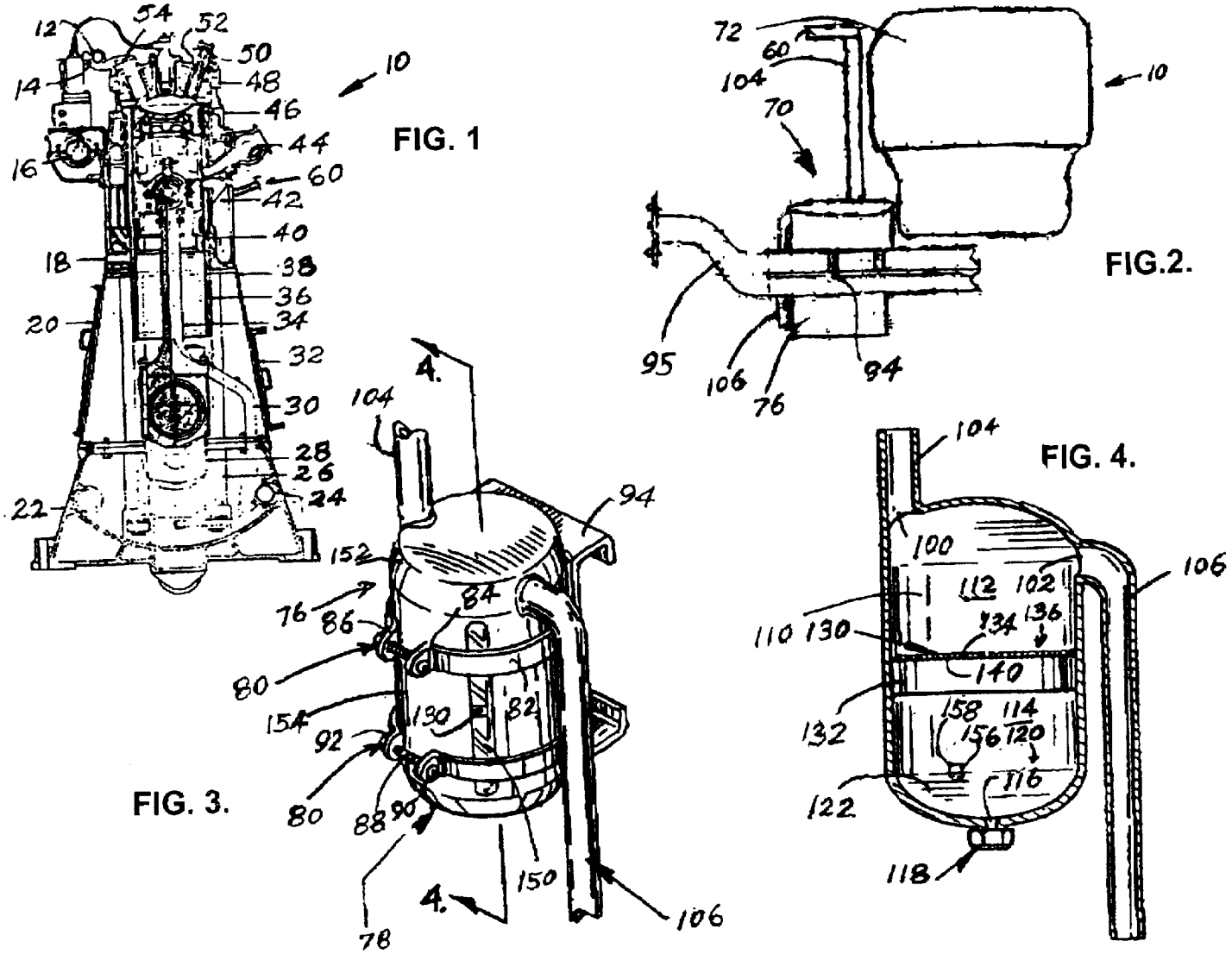
FIG. 1 is a schematic generally showing a diesel engine.
FIG. 2 is a schematic showing the relationship between a diesel engine and the fluid separator unit embodying the present invention.
FIG. 3 is a perspective view of the fluid separator unit embodying the present invention.
FIG. 4 is a view taken along line 4—4 of FIG. 3.

Other objects, features and advantages of the invention will become apparent from a consideration of the following detailed description and the accompanying drawings.

The fluid separator unit embodying the present invention is used in connection with a diesel engine, such as engine 10 shown in FIG. 1 and is used to remove particles that may be entrained in fluid that is vented from the internal engine block of that diesel engine. Diesel engine 10 is an example of the diesel engines that can benefit from the use of the fluid separator unit of the present invention and those skilled in the art will understand that other forms of diesel engines can be used as well without departing from the scope of the present disclosure. Diesel engine 10 generally includes a fuel header 12, a fuel injection pump 14, a camshaft 16, a cooling water inlet 18, a crankshaft inspection cover 20, a bed plate 22, an oil inlet header 24, a crankshaft tie rod 26, a crankshaft 28, a piston cooling oil drain 30, a crankcase safety cover 32, a connecting rod 34, a cylinder liner 36, an upper base 38, a piston 40, a scavenging air manifold 42, a rotary exhaust valve 44, a cylinder block 46, a cylinder head 48, a starting air valve 50, a fuel injection holder and nozzle 52 and a gas valve plug 54. Those skilled in the art will understand that the above description is only very broad and many other elements are also included in diesel engines.

As discussed above, some diesel engines include a vent, such as vent 60 that relieves pressure in the internal engine block. As also discussed above, such vents may conduct particles of oil into the environment. The fluid separator system embodying the present invention is used in connection with such vents to trap such entrained oil particles before they are vented to the atmosphere surrounding the diesel engine.

The broad orientation of a fluid separator unit 70 in relation to a diesel engine 10 is shown in FIG. 2, and the details of the fluid separator unit 70 are shown in FIGS. 3 and 4.

Referring to FIGS. 3 and 4, it can be understood that fluid separator unit 10 of the present invention comprises diesel engine 10 having an internal engine block vent 60 on internal engine block 72 fluidically connected to the internal engine block to vent internal pressure from the internal engine block.

The fluid separator unit of the present invention further includes a fluid separator 76 mounted on the vent 60 and fluidically connected to the vent 60. Fluid separator 76 includes a housing 78 and mounting elements 80 fixing housing 78 on the vent 60. Mounting elements 80 can include straps 82 which encircle the housing 78 and which include strap ends 84 spaced apart from each other and which have flanges 86 thereon. Tie bolts, such as threaded tie bolt 88, extend between the flanges 86 of the straps 82 and extend through bolt-receiving holes defined through the flanges 86. Fasteners, such as nut 90 and bolt head 92, attach the flanges 86 together and are used to tighten the straps 82 around housing 78. Straps 82 attach a C-shaped mounting flange 94 to housing 78. Flange 94 is mounted to a strut or other such element 95 near the engine to mount housing 78 in place to be fluidically connected to the vent 60 being used to relive pressure from the engine.

Fluid separator 76 further includes an inlet port 100 on housing 78, an outlet port 102 on housing 76, an inlet conduit 104 fluidically connecting inlet port 100 to the vent 60, and an outlet conduit 106 fluidically connecting outlet port 102 to the atmosphere. Housing 78 is hollow and has an internal volume 110 defined therein which fluidically connects inlet port 100 to outlet port 102. Internal volume 110 includes two sections 112 and 114. A drain port 116 is defined through housing 78 and is located at the bottom of the housing 78 when the housing 78 is in use. A cap 118 is removably mounted on the housing 78 to cover drain port 116 to close section 114 and trap oil in section 114 adjacent to the drain in an oil trap 120 as indicated by trapped oil 122. When desirable and suitable, housing 78 can be drained by simply opening drain 116.

It is noted that conduits 104 and 106, as well as internal volume 110 of housing 78, are sized so they will not interfere with the operation of the engine or the vent system. Those skilled in the art will understand how to design the system so it will not interfere with the operation of either the engine or the vent system of that engine.

The fluid separator 70 further includes a filter unit 130 in internal volume 110 of the housing. Filter unit 130 is fluidically interposed between inlet port 100 and oil trap 120 and is also located and oriented to be fluidically connected in parallel with inlet port 100 and outlet port 102. Filter unit 130 includes a filter element support 132 mounted on housing 78 and a filter element 134 supported on support 132. An upstream side 136 of filter element 134 is fluidically connected to inlet port 100 of housing 78 and a downstream side 140 of filter element 134 is fluidically connected to drain port 116 of housing 78. Particles entrained in fluid flowing through housing 78 from inlet port 100 to outlet port 102 will precipitate out onto filter element 134 and be trapped thereon. As those particles coalesce, the resulting fluid will drain through the filter element and into trap 120. Particle-free fluid will then flow out of outlet port 102 and into outlet conduit 106 to be vented to atmosphere.

As mentioned above, trap 120 should be drained from time to time. Draining of trap 120 is generally indicated when the trap becomes too full of trapped oil or other particles. In order to determine the fill level of the trap, fluid separator 76 includes a sight gauge 150 mounted on housing 78 and is connected to the housing 78 adjacent to drain port 116.

Housing 78 can include two sections, section 152 and section 154 which are releasably connected together. Releasing one section from the other will permit access to the interior of the housing 78 so filter unit 130 can be cleaned, serviced or replaced. A float device 156 can also be included in the fluid separator housing. Float device 156 can be electrically connected to an alarm, either visual or audible, located in the cab of the vehicle, to alert a driver that oil in the oil trap has reached a certain level and should be drained. The electrical connection between float 156 and the alarm system can be either via electrical connectors, such as electrical connector 158, or via wireless communication.

It is understood that while certain forms of the present invention have been illustrated and described herein, it is not to be limited to the specific forms or arrangements of parts described and shown.

I claim:

1. A fluid separator unit comprising:

a) a diesel engine having an internal engine block;

b) a vent on said internal engine block fluidically connected to said internal engine block to vent internal pressure from said internal engine block;

c) a fluid separator unit mounted on said vent and fluidically connected to said vent and including (1) a housing, (2) mounting elements fixing the housing of said fluid separator unit on said vent, (3) an inlet port on the housing of said fluid separator unit, (4) an outlet port on the housing of said fluid separator unit, (5) an inlet conduit fluidically connecting the inlet port on the housing of said fluid separator unit to said vent, (6) an outlet conduit fluidically connecting the outlet port on the housing of said fluid separator unit to the atmosphere, (7) an internal volume in the housing of said fluid separator unit fluidically connecting the inlet port of the housing of said fluid separator unit to the outlet port of the housing of said fluid separator unit, (8) a drain port on the housing of said fluid separator unit, (9) an oil trap in the housing of the fluid separator unit adjacent to the drain port, and

(10) a filter unit in the internal volume of the housing of said fluid separator unit fluidically interposed between the inlet port and the oil tap and fluidically in parallel with the inlet port and the outlet port, the filter unit including (A) a filter element support mounted on the housing of said fluid separator unit, (B) a filter element on the support of the filter unit, (C) an upstream side of the filter element fluidically connected to the inlet port of the housing of said fluid separator unit, and (D) a downstream side of the filter element fluidically connected to the drain port of the housing of said fluid separator unit; and d) a sight gauge mounted on the housing of said fluid separator unit and connected to the housing adjacent to the drain port.

2. The separator unit as described in claim 1 wherein the mounting elements of said fluid separator unit include straps encircling the housing of said fluid separator unit, screw elements on the straps, and a mounting bracket on the housing of said fluid separator unit.

3. The separator unit as described in claim 2 wherein said sight gauge is one-piece with the housing of said fluid separator unit.

4. The separator unit as described in claim 2 wherein the housing of said fluid separator unit includes two sections releasably coupled together.

* * * * *